US005524853A

United States Patent [19]

Varlaro

[11] Patent Number: 5,524,853

[45] Date of Patent: Jun. 11, 1996

[54] SWINGING MAILBOX SUPPORT

[76] Inventor: Joseph G. Varlaro, 19 Molland Dr., Rhinebeck, N.Y. 12572

[21] Appl. No.: 292,217

[22] Filed: Aug. 19, 1994

[51] Int. Cl.[6] ..... B65D 91/00

[52] U.S. Cl. ..... 248/145; 248/417; 232/39

[58] Field of Search ..... 248/417, 145, 248/289.3, 415, 131, 349; 232/39

[56] References Cited

U.S. PATENT DOCUMENTS

| | | | |
|---|---|---|---|
| 1,273,696 | 7/1918 | Vanhoof | 248/145 |
| 1,440,043 | 12/1922 | Wright | 248/289.3 X |
| 1,645,768 | 10/1927 | Morten, Jr. | 248/145 |
| 2,079,510 | 5/1937 | King et al. | 248/145 |
| 2,149,050 | 2/1939 | Hajicek | 248/145 |
| 2,550,338 | 4/1951 | Dunagan | 248/145 |
| 2,995,330 | 8/1961 | Alms | 248/145 |
| 3,283,358 | 11/1966 | Merriam | 248/349 X |
| 3,802,656 | 4/1974 | Virblas | 248/145 |
| 3,881,650 | 5/1975 | Schmidt | 232/39 |
| 4,187,978 | 2/1980 | Dowker | 248/145 X |

*Primary Examiner*—Karen J. Chotkowski

*Attorney, Agent, or Firm*—Ramon L. Pizarro; Edwin H. Crabtree

[57] ABSTRACT

A swinging mailbox support including a vertical post having a horizontal arm and brace disposed thereon wherein a mailbox is affixed to an end portion of the horizontal arm and furthermore the vertical post comprises two portions pivotably interconnected and tending to maintain a neutral initial state by the action of two opposing springs anchored to the ground on either die of the post. A pair of shields are provided to protect the mailbox from direct impact and additionally provide a surface for application of street numbers or other information. In operation the post supporting the mailbox is free to rotate about a central axis in the event of a collision with a vehicle or other object wherein springs restore the mailbox to an initial disposition thereafter.

15 Claims, 4 Drawing Sheets

SWINGING MAILBOX SUPPORT

BACKGROUND OF THE INVENTION

1. Field of the Invention

The present invention relates to post mounted mail receptacles and more particularly pertains to a swinging mailbox support which may be employed to permit a mailbox to rotate out of position when disturbed and to return to an original position afterward.

2. Description of the Prior Art

The use of post mounted mail receptacles is known in the prior art. More specifically, post mounted mail receptacles heretofore devised and utilized for reactively repositioning a mailbox when disturbed are known to consist basically of familiar, expected and obvious structural configurations, notwithstanding the myriad of designs encompassed by the crowded prior art which have been developed for the fulfillment of countless objectives and requirements.

The present invention is directed to improving devices for a swinging mailbox support in a manner which is safe, secure, economical and aesthetically pleasing.

For example, U.S. Pat. No. 5,215,283 to Gould discloses a swing-away mailbox support comprising a post interconnected by a resilient coupling wherein the coupling includes a cam, an adjustable internal primary spring, and an external secondary spring. The Gould invention provides a cam, an axially disposed spring member and an axially stressing resilient strap member for restoring a pivotally attached armlike member to a resting position upon a long post wherein one or more mailboxes are disposed upon the armlike member thereby providing for pivotal swinging of the armlike member if disturbed by vehicles, vandals, or snowplows. The present invention comprises a short earth mounted post member and a long post member having a mailbox or similar mail receptacle affixed thereon and furthermore the short earth mounted post member and the long post member are pivotally joined by an elongated rodlike member disposed within and centrally along a common axis thereof. Two opposing helical springs apply restoring force to maintain the swinging mailbox support in a correct alignment with the path of a mailman. There is no need for an axially disposed spring or resilient strap for operation and the intricacies of the Gould invention including a cam and grease fitting are not generally required for operation of the present invention.

In U.S. Pat. No. 5,042,716 to Robbins a pivotable mailbox and post assembly is disclosed. The Robbins invention comprises a mailbox affixed to a segmented post having an horizontally disposed pivotal axis joining two unequal length post segments thereof wherein the pivotal axis is positioned more proximate to the earth than to the mailbox and furthermore a vertical alignment of the post segments in the absence of external forces is provided by a torsion spring member mounted at the pivotal axis. In use the mailbox and a post segment are rotatably disposed by a mailman thereby permitting simplified introduction and removal of mail therewithin. After use the mailbox is freed and the post recovers to a substantially vertical alignment. The present invention is not devised to permit significant rotation of a mailbox about an horizonal axis, rather a mailbox and post portion are able to rotate about a vertical axis wherein restoration to an initial state is obtained by the action of two extensile external springs affixed thereto.

In U.S. Pat. No. 4,955,534 to Raible a swivel mailbox is described. The Raible invention comprises a mailbox affixed to a pivoting arm wherein the pivot axis is substantially along a centrally disposed line through an elongated mounting post, and furthermore a shear pin is provided to permit rotation of the pivoting arm upon application of a particular torque thereto as experienced when struck by a vehicle or snow plow blade. The Raible invention requires realignment or the pivoting arm and replacement of the shear pin each time the arm is struck. The present invention does not require a shear pin and is restored to an initial state after being struck without human intervention.

In U.S. Pat. No. 4,484,705 to Sande an adjustable and pivotal mailbox support is disclosed for providing a mailbox installed upon an arm which pivots completely about a vertical axis, is susceptible to lockable repositioning upon a vertically disposed tubular pole, and is further susceptible to horizontal respositioning. A disadvantage in this prior art lies in a lack of restoration to an initial state after being struck or otherwise disturbed. The present invention includes an opposing spring pair which by application of a moment thereto restores the mailbox to an initial state after encountering a disturbance.

U.S. Pat. No. 3,870,262 to Manning, Jr. discloses a swingable, demountable mailbox support. The disclosure teaches a pivoting horizontal bar having a horizontally sliding mailbox affixed at an end thereof and attached using two bearing members engaging an earth mounted vertical post member. The disclosure makes no provision for spring actuated restoration to an initial state and may be susceptible to retention of an adverse disposition. Furthermore, there are no provisions for retention of the horizontal bar and mailbox after a vehicular strike thereto. There is no teaching to employ conventional wooden support structures in the Manning Jr. invention. The present invention employs a pivoting mailbox support wherein a major portion of the support structure and mailbox are pivotable and furthermore spring restoration is employed to maintain an initial disposition after a disturbance is encountered.

In this respect, the swinging mailbox support according to the present invention substantially departs from the conventional concepts and designs of the prior art, and in so doing provides an apparatus primarily developed for the purpose of providing a mail receptacle support which responds to disturbances by pivoting to a new angular disposition and quickly returning to an initial state thereafter.

Therefore, it can be appreciated that there exists a continuing need for new and improved swinging mailbox support which can be employed to protect a mailbox from damage incurred by vehicle strikes, thrown objects, or snowplow blade impacts. In this regard, the present invention substantially fulfills this need.

As illustrated by the background art, efforts are continuously being made in an attempt to improve mailbox supports. No prior effort, however, provides the benefits attendant with the present invention. Additionally, the prior patents and commercial techniques do not suggest the present inventive combination of component elements arranged and configured as disclosed and claimed herein.

The present invention achieves its intended purposes, objects, and advantages through a new, useful and unobvious combination of method steps and component elements, with the use of a minimum number of functioning parts, at a reasonable cost to manufacture, and by employing only readily available materials.

SUMMARY OF THE INVENTION

In view of the foregoing disadvantages inherent in the known types of mailbox support now present in the prior art, the present invention provides an improved swinging mailbox support construction wherein the same can be utilized for protecting a mailbox from impacts and vandalism by permitting spring restored rotation thereof. As such, the general purpose of the present invention, which will be described subsequently in greater detail, is to provide a new and improved swinging mailbox support apparatus and method which has all the advantages of the prior art swinging mailbox supports and none of the disadvantages.

The invention is defined by the appended claims with the specific embodiment shown in the attached drawings. For the purpose of summarizing the invention, the invention may be incorporated into a vertically disposed support post and a horizontally disposed arm member having a mail receptacle thereattached. A lowermost portion of the support post is embedded and anchored in the earth and an elongated uppermost portion having the horizontally disposed arm member and mail receptacle attached is caused to pivot about an axle substantially aligned with the lowermost and uppermost support post longitudinal axes. A pair of spring members are each anchored to the earth on either side of and opposite the mail receptacle and an opposite end of the spring members is affixed to the horizontally disposed arm member thereby maintaining a neutral initial state for the mail receptacle wherein the mail receptacle is caused to return to the neutral initial state after being struck or otherwise disturbed.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. In as much as the foregoing has outlined rather broadly the more pertinent and important features of the present invention in order that the detailed description of the invention that follows may be better understood so that the present contribution to the art can be more fully appreciated. Additional features of the invention will be described hereinafter which form the subject of the claims of the invention. It should be appreciated by those skilled in the art that the conception and the disclosed specific methods and structures may be readily utilized as a basis for modifying or designing other structures for carrying out the same purposes of the present invention. It should be realized by those skilled in the art that such equivalent methods and structures do not depart from the spirit and scope of the invention as set forth in the appended claims.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

Therefore, it is an object of the present invention to provide an improved swinging mailbox support which is susceptible to wooden or metallic construction and may be installed using conventional tools and devices.

It is therefore an additional object of the present invention to provide a new and improved swinging mailbox support which has all the advantages of the prior art mailbox supports and none of the disadvantages.

It is another object of the present invention to provide a new and improved swinging mailbox support which may be easily and efficiently manufactured and marketed.

It is a further object of the present invention to provide a new and improved swinging mailbox support which is of a durable and reliable construction.

An even further object of the present invention is to provide a new and improved swinging mailbox support which is susceptible of a low cost of manufacture with regard to both materials and labor, and which accordingly is then susceptible of low prices of sale to the consuming public, thereby making such swinging mailbox supports economically available to the buying public.

Still yet another object of the present invention is to provide a new and improved swinging mailbox support which provides in the apparatuses and methods of the prior art some of the advantages thereof, while simultaneously overcoming some of the disadvantages normally associated therewith.

Still another object of the present invention is to provide a new and improved swinging mailbox support having spring actuated restoration to an initial state.

Yet another object of the present invention is to provide a new and improved swinging mailbox support having a protective barrier thereattached to preclude damage to the mailbox body itself.

Even still another object of the present invention is to provide a new and improved swinging mailbox support having a pivot axle positioned near ground level thereby altering the gyrating characteristics of the mailbox support assembly to better absorb energy imparted thereto without damage.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention. The foregoing has outlined some of the more pertinent objects of this invention. These objects should be construed to be merely illustrative of some of the more prominent features and applications of the present invention. Many other beneficial results can be attained by applying the disclosed invention in a different manner or by modifying the invention within the scope of the disclosure. Accordingly, other objects and a fuller understanding of the invention may be had by referring to the summary of the invention and the detailed description of the preferred embodiment in addition to the scope of the invention defined by the claims taken in conjunction with the accompanying drawings.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
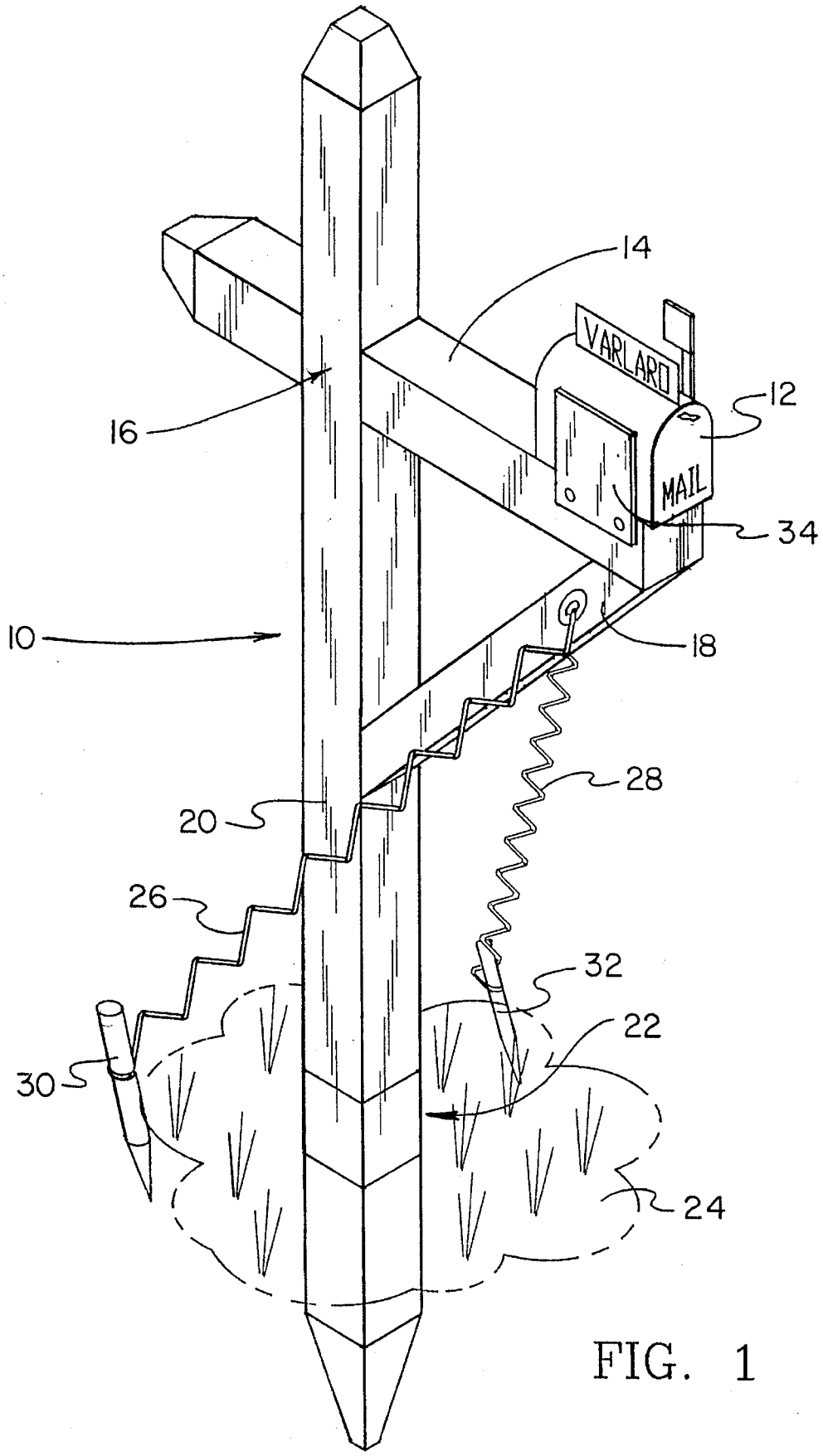
FIG. 1 is a perspective view of the swinging mailbox support showing a typical installation.

With reference now to the drawings, and in particular to FIG. 1 thereof, a new and improved swinging mailbox support embodying the principles and concepts of the present invention and generally designated by the reference numeral 10 will be described.

From an overview standpoint, the swinging mailbox support 10 is adapted for use with an existing mailbox 12 for the purpose of providing a pivotal removal of the mailbox 12 from the path of a vehicle or other item in the event of a collision therewith. See FIG. 1. Mailbox 12 is permanently affixed to horizontal support arm 14 wherein horizontal support arm 14 is affixed to post 16 and further supported by brace 18. Post 16 maintains a substantially vertical disposition and comprises a first elongated upper portion 20 and a lower portion 22 embedded in earth 24 wherein upper portion 20 and lower portion 22 are pivotally attached. Springs 26 and 28 are affixed to horizontal support arm 14 and embedded anchor pins 30 and 32. Shields 34 and 36 are provided to protect mailbox 12 from direct impact.

More specifically, it will be noted that the swinging mailbox support 10 comprises a post 16 having a horizontal support arm 14, shields 34, and brace 18 disposed thereon and furthermore springs 26 and 28 are thereattached and anchored by anchor pins 30 and 32. Post 16 comprises a first portion 20 and a second portion 22 wherein the major composition of the post 16 is wood and a general common stock employed is either four by four inch or six by six inch pressure treated or cedar post material. Likewise, the major composition of the support arm 14 and brace 18 is wood of substantially identical cross section and composition as post 16. Support arm 14 may be permanently affixed to post 16 by bolts, nails, screws or techniques of wood joining involving interlocking joints. Brace 18 is disposed at an angle to both post 16 and support arm 14 and is permanently attached thereto using bolts, nails, screws or techniques of wood joining involving interlocking joints.

Figures 2, 3:
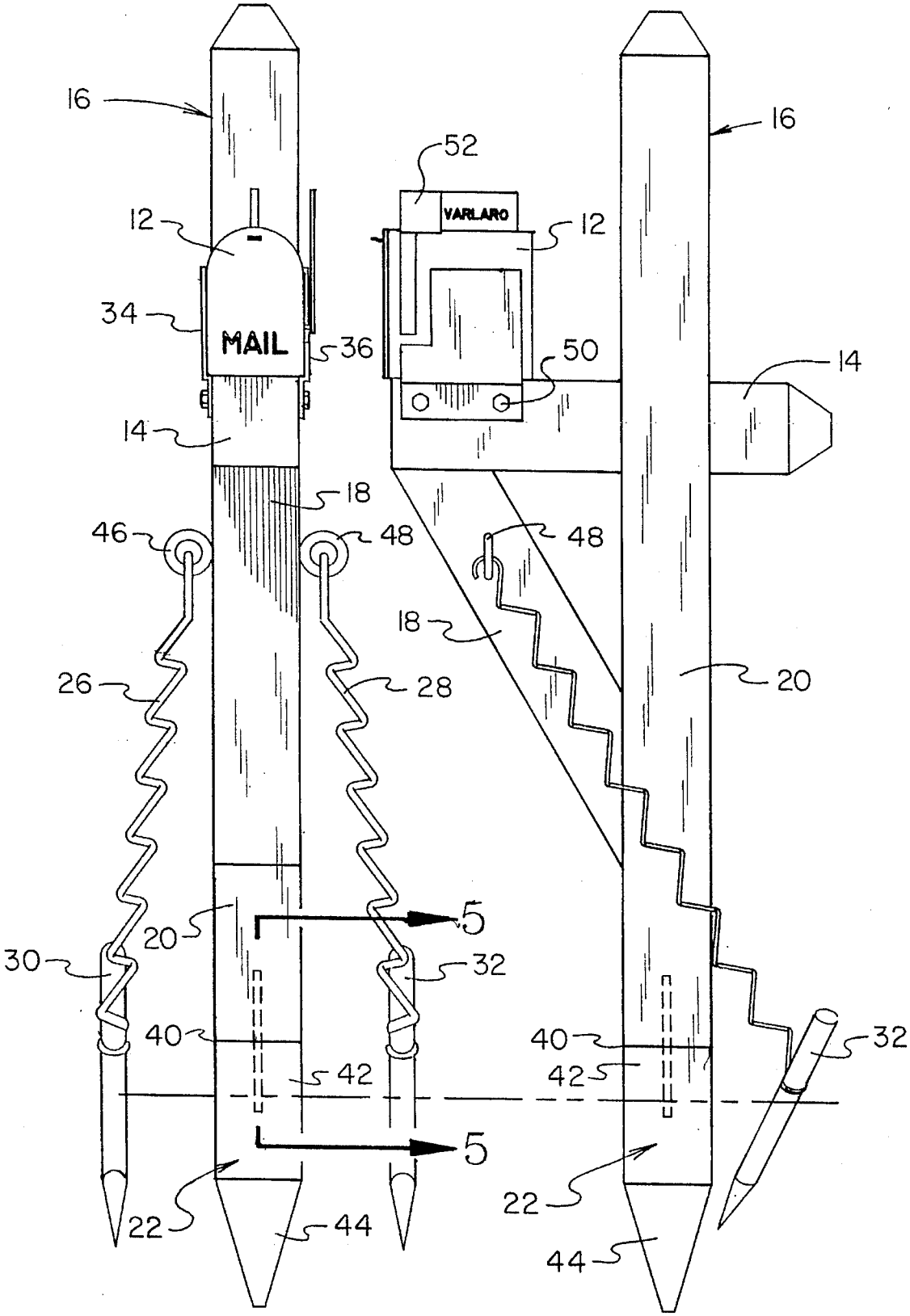
FIG. 2 is a side elevational view of the swinging mailbox support in an initial state position.
FIG. 3 is side elevational view of the swinging mailbox support showing in an initial state position.

First portion 20 of post 16 comprises an elongated section terminating at pivotal interface 40 by a substantially precisely orthogonal crosscut thereto. See FIG. 2. Second portion 22 comprises a stakelike part having a substantially precisely orthogonal crosscut disposed at a first end 42 thereof wherein pivotal interface 40 is disposed, and has a pointed second end 44 thereof. Second portion 22 may be driven into the earth using a protective block upon first end 42 or, as preferred, may be embedded in cementitious material comprising an aggregate dispersed in an hardening cement. Second portion 22 is necessarily provided a substantially vertical disposition after being embedded in the earth 24.

Springs 26 and 28 comprise extension springs of metallic composition having a machine or hand loop 46 and 48 formed at each free end thereof. Springs 26 and 28 are of composition ensuring immunity to the weather and salts or other materials employed for the purpose of mitigating ice and snow conditions. Springs 26 and 28 may alternately be cone ended having swivel loops or hooks there attached, or may comprise a smaller spring member having a cord or cable attached thereto and to either the anchor pins 30 and 32 or to support arm 14.

Shields 34 and 36 comprise metallic or wooden platelike structures preventing objects from directly striking a major portion of mailbox 12. Shields 34 and 36 are affixed to support arm 14 by threaded fasteners 50. See FIG. 3. Shield 34 may differ significantly in shape from shield 36 primarily to accommodate a postal flag 53 which requires pivotal movement without mechanical or visual interference. And decorative elements may be included in the design of shields 34 and 36 whereby a more aesthetically pleasing appearance may issue or a more practical form such as rolling the shields into a form suitable for employ as a newspaper receptacle may be included.

Figure 4:
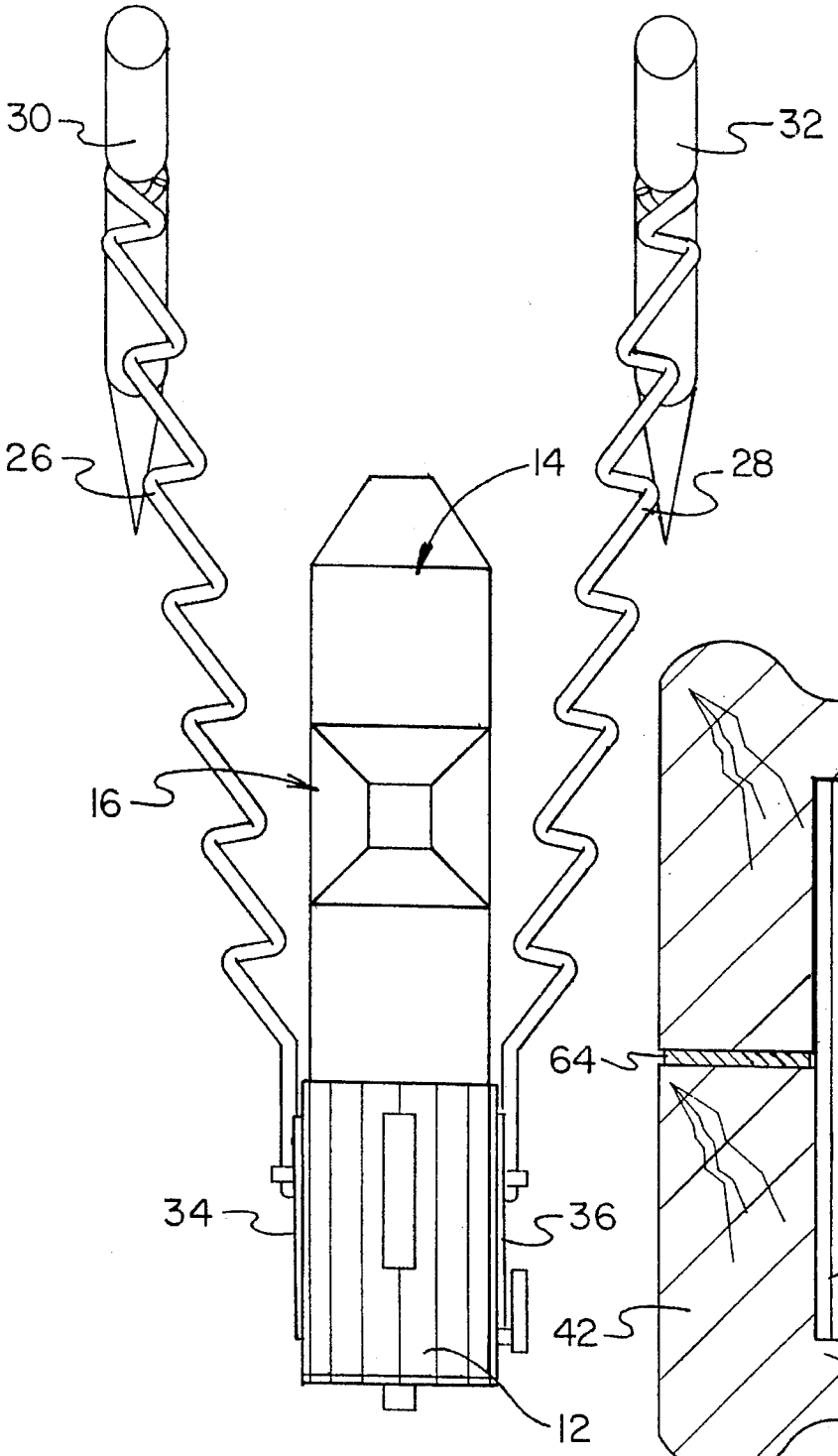
FIG. 4 is a side elevational view of the swinging mailbox support in an initial state position.

The general disposition of springs 26 and 28 require that a moment be applied to support arm 14 which restores support arm 14 to an initial state. Anchor pins 30 and 32 are therefore suitably disposed on opposite sides of a plane containing post 16 and support arm 14 and furthermore are positioned substantially equidistantly from post 16 on a side thereof opposite mail box 12. See FIG. 4. The aforementioned arrangement of springs 26 and 28 will provide a lesser moment when mailbox 12 is substantially in a disturbed state than when in an initial state.

Figure 5:
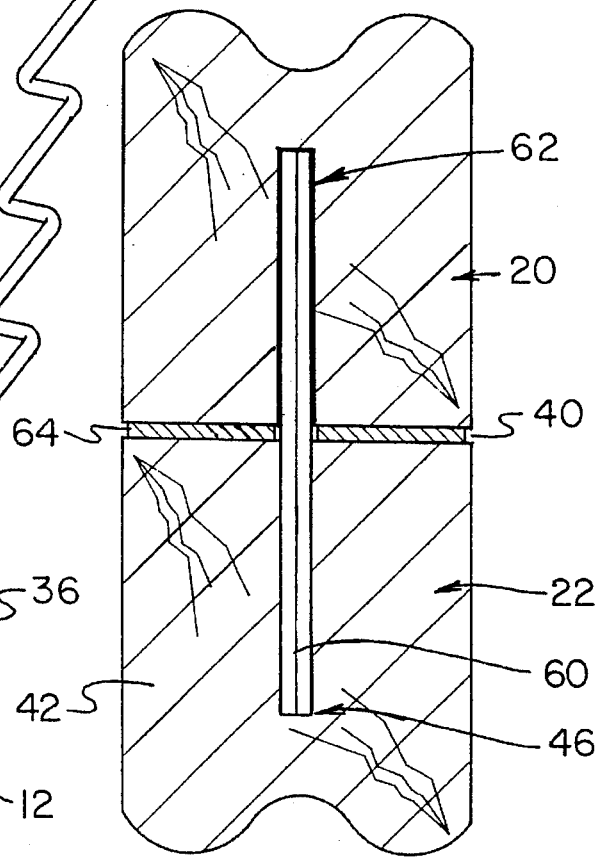
FIG. 5 is a fragmentary side sectional view of a swinging mailbox support taken substantially upon the plane indicated by the section line 5—5 of FIG. 2.

First portion 20 and second portion 22 of post 16 are rotatably joined at pivotal interface 40 by axle 60. See FIG. 5. Axle 60 engages hole 62 bored centrally in first portion 20 and engages hole 64 bored centrally in second portion 22. Engagement of axle 60 with holes 62 and 64 provides substantially free rotation of first portion 20 without wobble or excessive looseness. Lubricants such as greases and oils may be employed to coat axle 60 for improved performance. Washer 64 is employed as a thrust bearing wherein the weight of first portion 20 and all attachments thereto is supported without rotational binding. Lubricants may also be applied to washer 64 to reduce friction.

Figure 6:
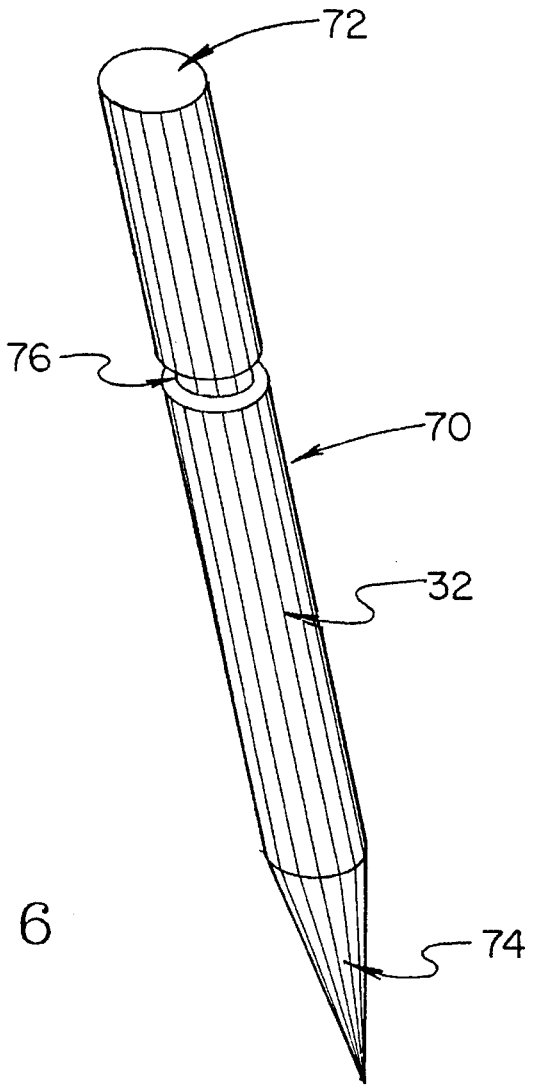
FIG. 6 is a perspective view of the swinging mailbox support showing a spring member anchor stake.

Anchor pins 30 and 32 comprise a rodlike body 70 having a flattened first free end 72 and a pointed second free end 74 wherein the pointed end 74 is introduced into the earth 24 by striking first free end 72 using a hammerlike tool. See FIG. 6. Groove 76 is circumferentially disposed upon body 70 thereby providing a spring engagement region. In general, anchor pins 30 and 32 are of metallic composition, however polymeric structures may be used.

Figure 7:
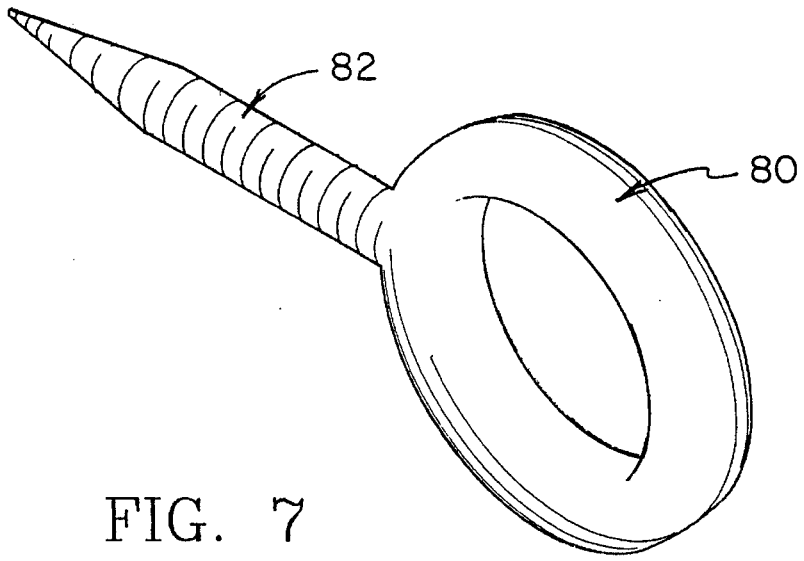
FIG. 7 is a perspective view of the swinging mailbox support showing an eye bolt fastener.

Springs 26 and 28 are affixed to support arm 14 using eye screw 80. See FIG. 7. Eye screws 80 comprise a threaded portion 82 affixed to a ringlike portion 84 wherein ringlike portion 84 engages spring 26 or spring 28 thereby affixing spring 26 or spring 28 to support arm 14.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention. In as much as the present disclosure includes that contained in the appended claims as well as that of the foregoing description. Although this invention has been described in its preferred forms with a certain degree of particularity, it is understood that the present disclosure of the preferred form has been made only by way of example and numerous changes in the details of construction and combination and arrangement of parts may be resorted to without departing from the spirit and scope of the invention.

What is claimed as being new and desired to be protected by Letters Patent of the United States is as follows:

1. A mailbox support for supporting a mailbox in a resting position and allowing the mailbox to respond to a side impact force on the mailbox by swinging away from the force and then returning to the resting position, the mailbox support comprising:

a substantially vertical post member having an upper portion, a lower portion that is fixably connectable to earth, and an axial pivot means for pivotally connecting the upper portion of the vertical post member to the lower portion of the vertical post member;

a substantially horizontal mailbox support arm affixed to the upper portion of said vertical post member;

spring means having at least two ends, one end of said spring means being connected to said support arm;

anchor means for connecting another end of said spring means to earth, so that a mailbox mounted on said mailbox support arm will swing away in response to a side impact, and then return to its original resting position by means of a bias imposed on said support arm by said spring means.

2. A mailbox support according to claim 1, wherein said spring means comprises a pair of extension springs, both spring being attachable at a section along said support arm and diverging towards said anchor means.

3. A mailbox support according to claim 1 wherein said means for pivotally connecting the upper portion of the vertical post member to the lower portion of the vertical post member comprises an axle means for allowing axial rotation of said upper portion of the vertical post member.

4. A mailbox support according to claim 3, wherein said extension springs are metallic helical springs.

5. A mailbox support according to claim 4, and further comprising a mailbox shield means on said support arm.

6. A mailbox support according to claim 5, wherein said anchor means comprise elongate pins.

7. A mailbox support for supporting a mailbox in a resting position and allowing the mailbox to respond to a side impact force on the mailbox by swinging away from the force and then returning to the resting position, the mailbox support comprising:

a substantially vertical post member having an upper portion, a lower portion that is fixably connectable to earth, and axial pivot means for pivotally connecting the and allowing axial movement of the upper portion of the vertical post member relative to the lower portion of the vertical post member;

a substantially horizontal mailbox support arm affixed to the upper portion of said vertical post member;

at least two diverging longitudinal spring means, each spring means having first and second ends, the first end of each of said spring means being connected to said support arm;

anchor means for fixing the second end of each of said spring means to earth, so that the springs retain said support arm in a normal resting position, and so that a mailbox mounted on said mailbox support arm will swing away along with said support arm when the mailbox is struck, and so that the mailbox will then be returned to its original resting position by bias from said spring means.

8. A mailbox support according to claim 7, wherein said spring means comprises a pair of extension springs.

9. A mailbox support according to claim 8, wherein said extension springs are metallic helical springs.

10. A mailbox support according to claim 8, and further comprising a mailbox shield means on said support arm.

11. A mailbox support according to claim 10, wherein said anchor means comprise elongate pins.

12. A mailbox support according to claim 7 wherein said means for pivotally connecting the upper portion of the vertical post member to the lower portion of the vertical post member comprises an axle means for allowing axial rotation of said upper portion of the vertical post member and a thrust washer disposed about said axle means.

13. A method for providing a mailbox support for supporting a mailbox in a resting position and allowing the mailbox to respond to a side impact force on the mailbox by swinging away from the force and returning to the resting position, the method comprising:

providing a mailbox support having a substantially vertical post member having an upper portion and a lower portion and a substantially horizontal mailbox support arm affixed to the upper portion of the post member;

parting the upper portion of the vertical post member from the lower portion of the vertical post member;

attaching an axial pivot means for pivotally connecting the upper portion of the vertical post member to the lower portion of the vertical post member;

attaching an end of a spring means having at least two ends to the support arm;

providing anchor means for connecting another end of the spring means to earth; and attaching another end of the spring means to the anchor means, so that a mailbox mounted on the mailbox support arm will swing away in response to a side impact, and then return to its original resting position by means of a bias imposed on the support arm by the spring means.

14. A method for providing a mailbox support for supporting a mailbox according to claim 13 wherein the step of attaching an axial pivot means for pivotally connecting the upper portion of the vertical post member to the lower portion of the vertical post member further comprises:

boring a hole in the upper portion of the vertical post member;

boring a hole in the lower portion of the vertical post member;

inserting an axle means in the hole bored in the lower portion of the vertical post member; placing a thrust bearing means about the axle; and inserting the axle means in the hole bored in the upper portion of the vertical post member, so that the upper portion of the vertical post member and lower portion of the vertical post member are pivotally connected and may pivot relative to each other about an axis.

15. A method for providing a mailbox support for supporting a mailbox according to claim 14, and further comprising the step of attaching a mailbox shield means on the horizontal mailbox support arm.

* * * * *